US009144726B2

(12) United States Patent
Whitney et al.

(10) Patent No.: US 9,144,726 B2
(45) Date of Patent: Sep. 29, 2015

(54) BAT SWING TRAINING DEVICE

(71) Applicant: Swingrite, LLC., Boxford, MA (US)

(72) Inventors: Charles E Whitney, Boxford, MA (US); Anthony L Mandia, Manchester, MA (US); Thomas Brady, Ashland, MA (US)

( * ) Notice: Subject to any disclaimer, the term of this patent is extended or adjusted under 35 U.S.C. 154(b) by 141 days.

(21) Appl. No.: 13/927,298

(22) Filed: Jun. 26, 2013

(65) Prior Publication Data

US 2015/0005111 A1 Jan. 1, 2015

(51) Int. Cl.
*A63B 69/00* (2006.01)

(52) U.S. Cl.
CPC ..... *A63B 69/0002* (2013.01); *A63B 69/00* (2013.01); *A63B 2069/0004* (2013.01); *A63B 2243/0008* (2013.01)

(58) Field of Classification Search
CPC ..... A63B 69/0002; A63B 69/00; A63B 2243/0008; A63B 2069/0004; A63F 9/34; A63F 2009/345; A63F 2007/405; A63F 2007/4056
USPC ..... 473/422, 437, 457, 564, 521, 519
See application file for complete search history.

(56) References Cited

U.S. PATENT DOCUMENTS

| | | | | |
|---|---|---|---|---|
| 2,772,887 | A | 12/1956 | Blake | |
| 3,137,504 | A * | 6/1964 | Zordan | 473/457 |
| 3,578,801 | A * | 5/1971 | Piazza | 473/457 |
| 4,274,631 | A | 6/1981 | Hayazaki | |
| 4,317,567 | A | 3/1982 | Blake | |
| 4,614,343 | A | 9/1986 | Radway | |
| 4,794,905 | A * | 1/1989 | Woolard | 124/5 |
| 4,898,386 | A * | 2/1990 | Anderson | 473/457 |
| 5,133,551 | A * | 7/1992 | Handy et al. | 473/567 |
| 5,590,875 | A * | 1/1997 | Young | 473/457 |
| D404,097 | S | 1/1999 | Tyner | |
| 6,050,908 | A | 4/2000 | Muhlhausen | |
| 6,139,451 | A | 10/2000 | Hillerich, III et al. | |
| D457,929 | S | 5/2002 | Ciesar et al. | |
| D461,213 | S | 8/2002 | Smith | |
| 6,565,462 | B1 | 5/2003 | Gregg | |
| 6,569,042 | B2 | 5/2003 | LaChance et al. | |
| D483,827 | S | 12/2003 | Ciesar | |
| 6,949,036 | B2 | 9/2005 | Ciesar et al. | |
| 7,008,351 | B2 * | 3/2006 | Parker | 473/422 |
| 7,144,329 | B2 * | 12/2006 | Tamura | 473/223 |
| 7,147,580 | B2 | 12/2006 | Nutter et al. | |
| 7,297,077 | B1 | 11/2007 | Battaglino | |
| 7,462,140 | B1 * | 12/2008 | Lombardozzi | 482/82 |
| 7,621,859 | B2 * | 11/2009 | Kim | 473/231 |
| 7,727,090 | B2 * | 6/2010 | Gant | 473/453 |
| 7,993,219 | B2 | 8/2011 | Whitney et al. | |
| 8,118,693 | B2 | 2/2012 | Tande | |
| 8,137,219 | B2 * | 3/2012 | Gant | 473/453 |
| 8,187,124 | B2 | 5/2012 | Ciesar et al. | |
| 8,821,323 | B2 * | 9/2014 | Liu et al. | 473/457 |
| 8,888,614 | B2 * | 11/2014 | Nutter | 473/457 |

* cited by examiner

*Primary Examiner* — Mitra Aryanpour
(74) *Attorney, Agent, or Firm* — George A Herbster

(57) ABSTRACT

A bat swing training device for enabling the diagnosis and correction of an individual batter's swing. The training device includes a conventional bat modified to receive a training aid at its distal. The training aid provides a snapping sound if an individual swings the bat at greater than a predetermined speed such that inertial forces overcome magnetic forces acting on a paramagnetic slider and the slider accelerates from a first stop to a second stop producing a snap. The position of the batter's hands at the time of the snap indicates whether the batter's swing is correct.

8 Claims, 7 Drawing Sheets

BAT SWING TRAINING DEVICE

BACKGROUND OF THE INVENTION

1. Field of the Invention

This invention generally relates to instructional devices for improving an individual's bat swing and more particularly to an instructional device that enables an individual to achieve a proper bat swing for improved hitting.

2. Description of Related Art

The prior art is replete with diverse apparatus for improving the quality of an individual's bat swing. Examples are shown in the following United States Letters Patent:

| | | |
|---|---|---|
| 4,274,631 | (1981) | Hayazaki |
| 6,050,908 | (2000) | Muhlhausen |
| 6,565,462 | (2003) | Gregg |
| 6,569,042 | (2003) | LaChance et al. |
| 6,949,036 | (2005) | Ciesar et al. |
| 7,147,580 | (2006) | Nutter et al. |
| 7,297,077 | (2007) | Battaglino |
| 7,993,219 | (2011) | Whitney et al. |
| 8,118,693 | (2012) | Tande |
| 8,187,124 | (2012) | Ciesar et al. |

U.S. Pat. No. 4,274,631 discloses a baseball practice bat that emits a hitting sound upon swinging. The practice bat includes a hollow interior or cavity. A pipe in the cavity extends for essentially the entire length of the bat. Guide slits, formed along the length of the pipe, receive a supporting pin attached to a weight that slides along the pipe. A spring extends inside the pipe from the supporting pin to the handle end of the bat. The handle end may attach to an adjustment mechanism for varying the spring's tension.

U.S. Pat. Nos. 6,050,908 and 6,949,036 and 7,147,580 and 7,297,077 disclose bat simulators used for training. In addition, U.S. Pat. No. 7,147,580 includes a sliding mass that apparently changes the dynamics of the bat but produces no audible sound. None of these references discloses a training aid that has the look and feel of a conventional baseball bat. U.S. Pat. Nos. 6,050,908 and 6,565,462 require that a ball be thrown to the person using the training device. U.S. Pat. No. 6,569,042 provides speed information, but not all the information necessary to provide proper swing information.

U.S. Pat. No. 7,993,219 to Whitney et al. discloses a bat swing training device that enables the diagnosis and correction of an individual batter's swing. The training device includes a conventional bat modified to receive a training aid at its distal end with either an exposed extended assembly or an embedded assembly. The training aid provides a snapping sound as an individual swings a bat at greater than a predetermined speed. The position of the batter's hands at the time of the snap indicates whether the batter's swing is correct. A restraining structure includes a cartridge and a finger that can release a ring from a cocked position. After a swing, the batter manually displaces the cartridge so that a ring can be returned to its cocked position. It has been found that during practice a batter prefers to make repetitive swings without any further adjustments. However, this bat swing training device requires the batter to manually reset the device by displacing an exposed structure at the end of the bat prior to assuming a batting stance.

U.S. Pat. No. 8,118,693 to Tande and U.S. Pat. No. 8,187,124 to Ciesar et al. disclose practice bats with similar structures. In Tande the practice bat includes an elongated shaft with a free sliding region and first and second damping regions. When the practice bat is swung, a slider and a damper slide to the end of the bat where the slider impacts the damper to indicate swing quality. Ciesar discloses a shaft with first and second handles. The first handle accommodates both of the hitter's hands; the second handle accommodates all the fingers on a hand. During a swing the batter simultaneously moves the second handle to a stop position. Neither practice bat has the structure, appearance and look and feel of a conventional baseball bat.

What is needed is a bat swing training device that has the look, feel and weight of a batter's conventional bat and that eliminates the need for any batter action between practice swings to reset the training device.

SUMMARY

Therefore it is an object of this invention to provide an improved bat swing training device for enabling an individual to achieve a proper swing for maximum impact without the need for contact with a thrown ball.

Another object of this invention is to provide an improved bat swing training device that facilitates the correction of an individual's swing and that closely simulates the physical and visual characteristics of a conventional bat.

Still another object of this invention is to provide an improved bat swing training device that has the look and feel of a conventional bat and enables a batter to take successive swings without having to release the batter's hands from the bat to reset or cock the training aid mechanism.

In accordance with one aspect of this invention, a bat swing training device for use in correcting a batter's swing includes a conventional baseball bat with a proximal handle or grip, a barrel portion and a distal barrel end. An axial passage extends proximally from the distal tip into the bat to receive the training aid which is affixed to the bat. The training aid includes a structure that, at a predetermined bat speed, releases a magnetically captured slider ring that travels on a shaft in a tubular housing to snap against a distal stop.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DESCRIPTION OF ILLUSTRATIVE EMBODIMENTS

Figure 1:
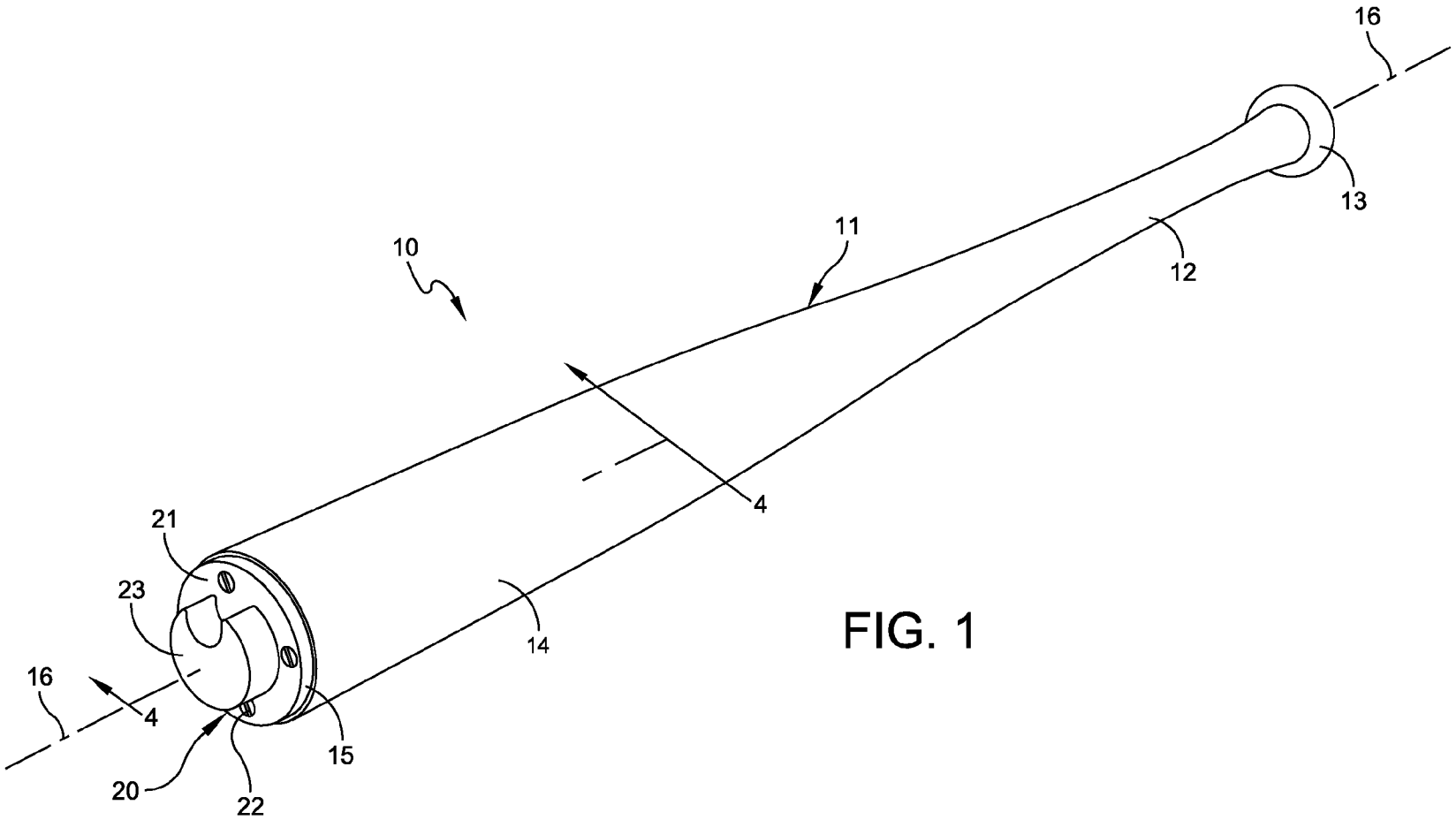
FIG. 1 is a perspective view of a bat swing training device that incorporates this invention.
Figure 2:
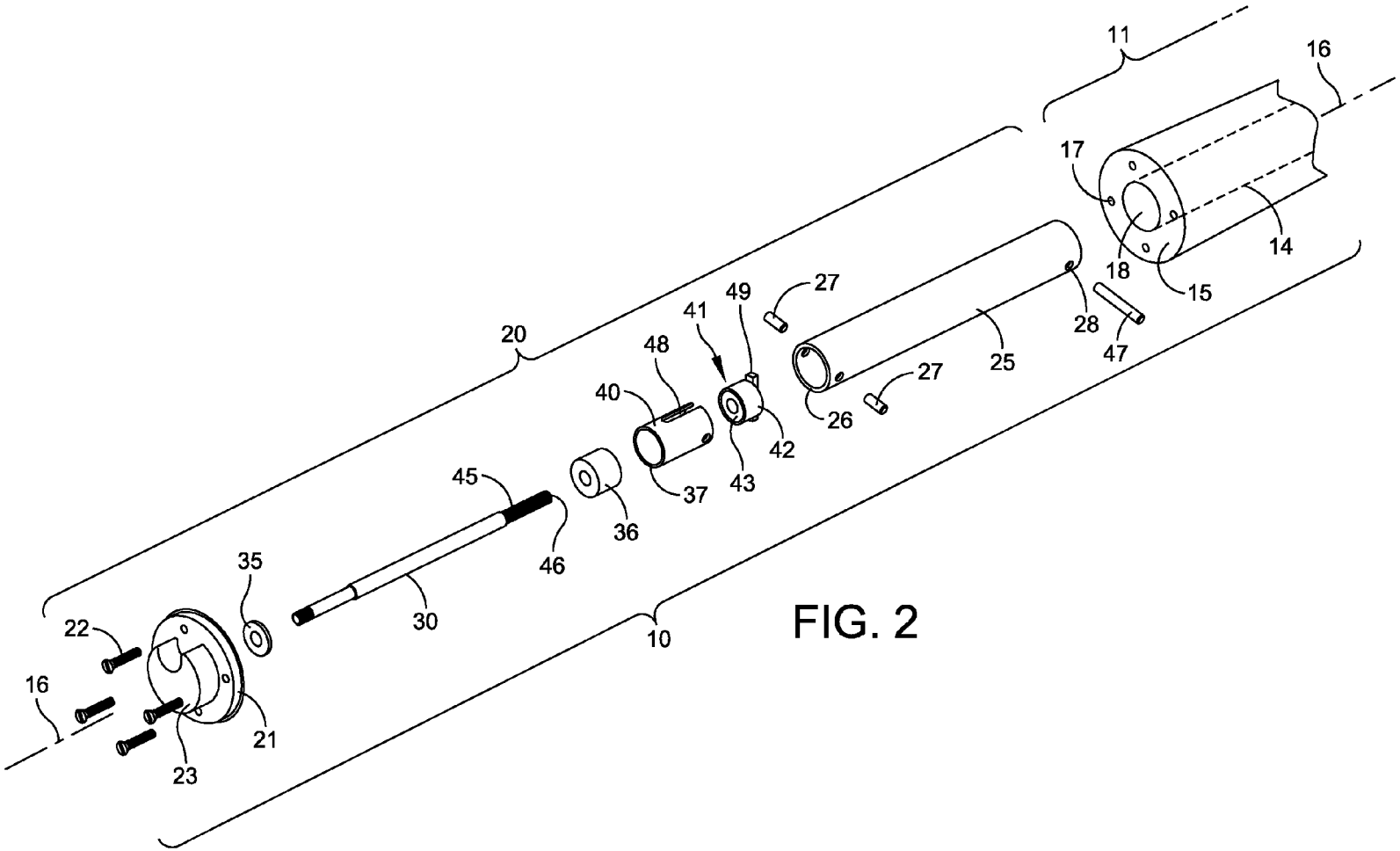
FIG. 2 is an exploded view of the bat swing training device and the distal end of a bat.
Figure 3:
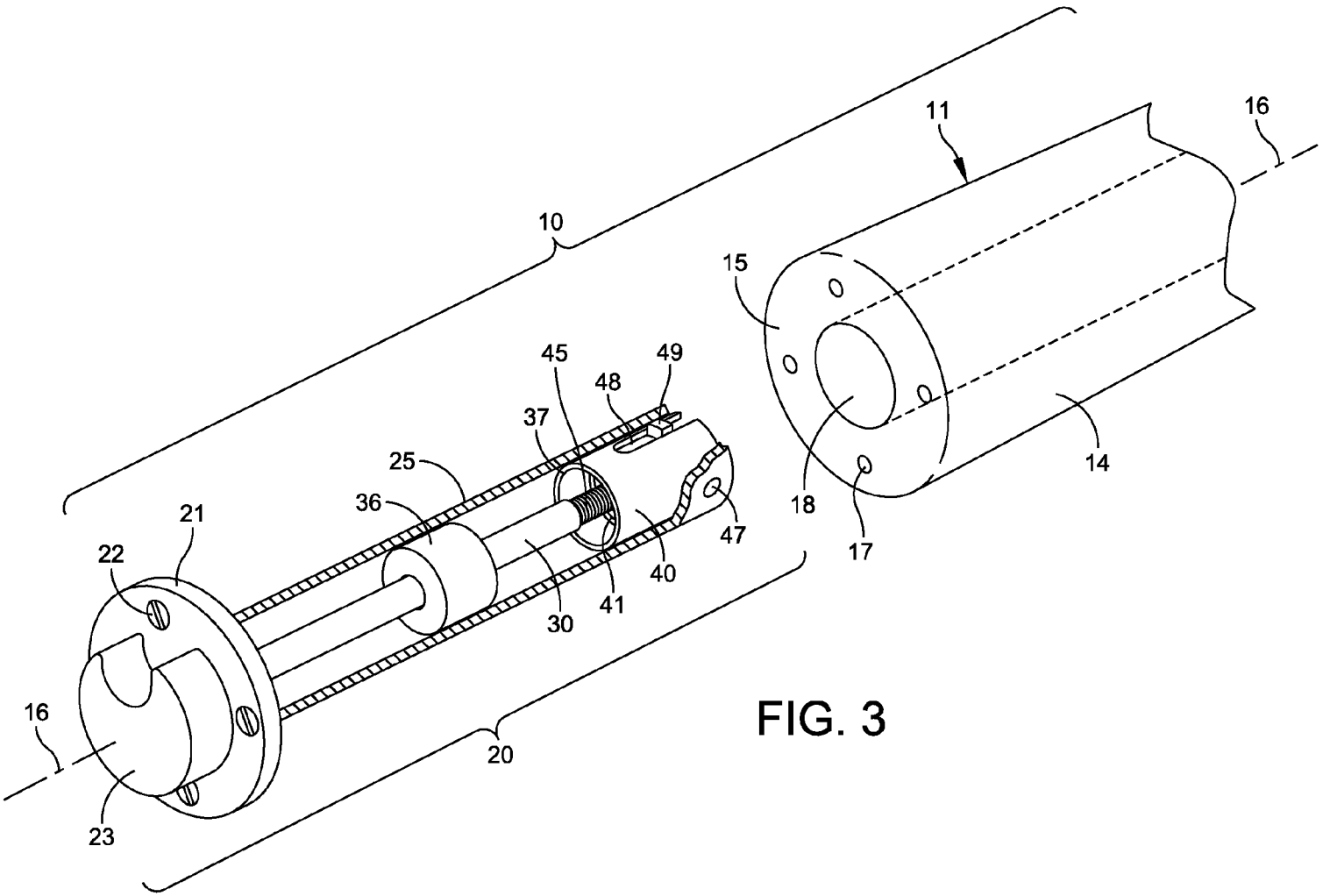
FIG. 3 is a perspective view of the training aid device of FIG. 2 depicting the training device in partial cross section positioned for attachment to the bat in FIGS. 1 and 2.

FIGS. 1 and 2 depict a bat swing training device 10 that incorporates this invention for correcting errors in the swing of a baseball player. The bat swing training device 10 includes a conventional bat 11 having a handle or grip portion 12, a proximal knob or butt end 13, an integral barrel 14 and a distal barrel end or tip 15, all lying along a bat axis 16. The bat 11 is modified by pilot holes 17 formed in the bat 11 at the distal end 15 and by the formation of a cavity 18 that opens at the distal end 15 and extends along the bat axis 16.

The bat 11 with these modifications receives a training aid 20, a portion of which is external to the bat and attached to the distal end 15. FIG. 1 depicts an end plate 21 which is a component of the training aid 20. Fasteners 22, such as screws, attach the end plate 21 to the bat 11 at the distal tip 15. A force control knob 23 enables a retention force to be adjusted as will be described later. The main portion of the training aid 20 is located internally of bat 11 along the bat axis 16.

As shown particularly in FIGS. 3 through 6, the end plate 21 includes a proximally extending shoulder 24 that supports a sheath 25 at its distal end 26. More specifically, the distal end 26 overlies the shoulder 24 and is secured to the shoulder 24 by fasteners, such as pins 27 shown in FIG. 2. The end plate 21 and sheath 25 thereby form an integral structure.

The end plate 21 also carries a shaft 30 in a journal 31 for rotation about the bat axis 16. A threaded portion 32 at the distal end of a shaft 30 extends distally of the end plate 21 (i.e. to the left in FIGS. 2 through 6) to receive a force control knob 23. The force control knob 23 is affixed to the end of the shaft 30 by means of a radial set screw (not shown) located in a radially extending threaded hole 33. Rotating the force control knob 23 rotates the shaft 30.

The shaft 30 includes a radial shoulder 34 closely spaced to the proximal end of the shoulder 24 thereby to provide a seat for a washer 35. The shoulder 34 and the force control knob 23 limit axial displacement of the shaft 30.

As described later, the washer 35 acts as a stop for a ring slider 36 located on the shaft 30. The ring slider 36 is formed of a paramagnetic material. In this embodiment the ring slider 36 is a cylindrical structure that is free to move between a first stop formed by the distal end 37 of a cylindrical insert 40 to limit proximal motion of the ring slider 36. The washer 35 acts as a second stop that limits axial displacement of the ring slider in the distal, or opposite, direction. The ring slider 36 and the cylindrical insert 40 are both located within the sheath 25. Other structures should also be substituted.

Still referring to FIGS. 2 through 6, the training aid 20 includes a permanent magnet subassembly 41 formed with a cup-shaped body 42, that receives a permanent magnet 43. In a preferred embodiment, the permanent magnet 43 is a neodymium ring magnet, specifically a R844 neodymium ring magnet supplied by K&J Magnetics, Inc. The annular cup-shaped body 42 includes internal threads 44 that engage external threads 45 on the shaft 30. The external threads 45 extend from the proximal end 46 of the shaft 30 to a point that is essentially coextensive with the distal end 37 of the cylindrical insert 40. A pin 47 extends through openings at the proximal end of the sheath 25 and the cylindrical insert 40 to prevent any axial or rotational motion of the cylindrical insert 40 relative to the sheath 25 during use. Other structures could implement the subassembly 41 with different configurations and permanent magnets.

The cylindrical insert 40 and the cup-shaped body 42 incorporate anti-rotation means for blocking rotation of the cup-shaped body 42 when the shaft 30 rotates such that the permanent magnet subassembly 41 is limited to linear axial displacement along the bat axis 16. More specifically, the cylindrical insert 40 includes axially extending slots 48 that are open to the proximal end. The annular cup-shaped body 42 includes radially extending ears or tangs 49 that extend radially through the slots 47. This blocks any rotation of the annular cup-shaped body 40 relative to the bat axis 16 upon rotation of the force control knob 23.

Figure 4:
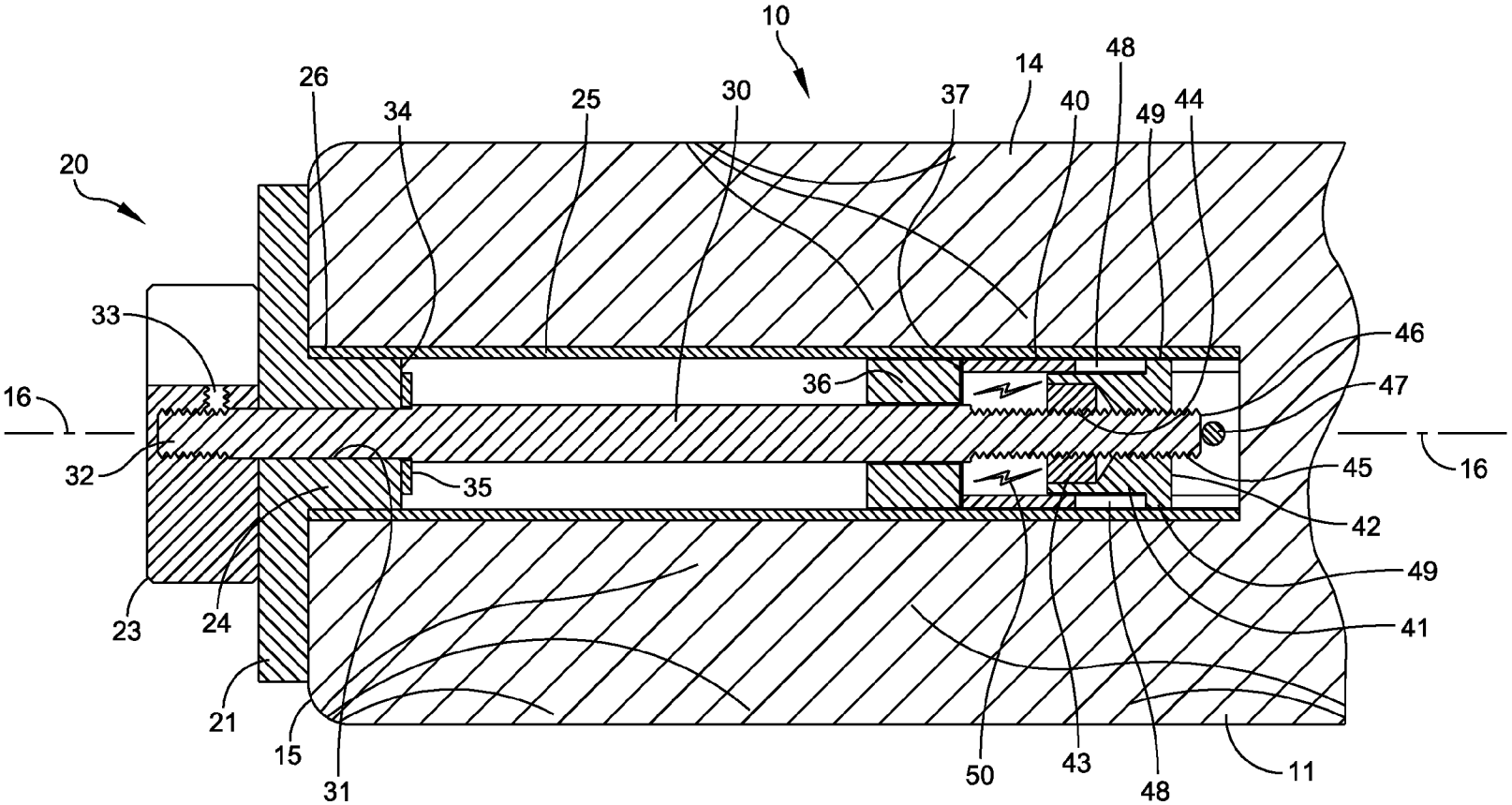
FIG. 4 is a cross-sectional view of the training device taken along lines 4-4 in in FIG. 1 in a normal or "cocked" state.

FIG. 4 depicts the training aid in a normal or cocked state. Specifically, the ring slider 36 is held against the distal end 37 of the cylindrical insert 40 by being in close proximity for the permanent magnet 43. The permanent magnet subassembly 41 is at an intermediate position along the external threads 45 on the shaft 30. The permanent magnet 43 produces a restraining force that attracts the ring slider 36 to the distal end 37. During normal handling prior to swinging the bat, this magnetic attraction is sufficient to maintain this configuration for bat orientations prior to an actual practice swing.

Figure 5:
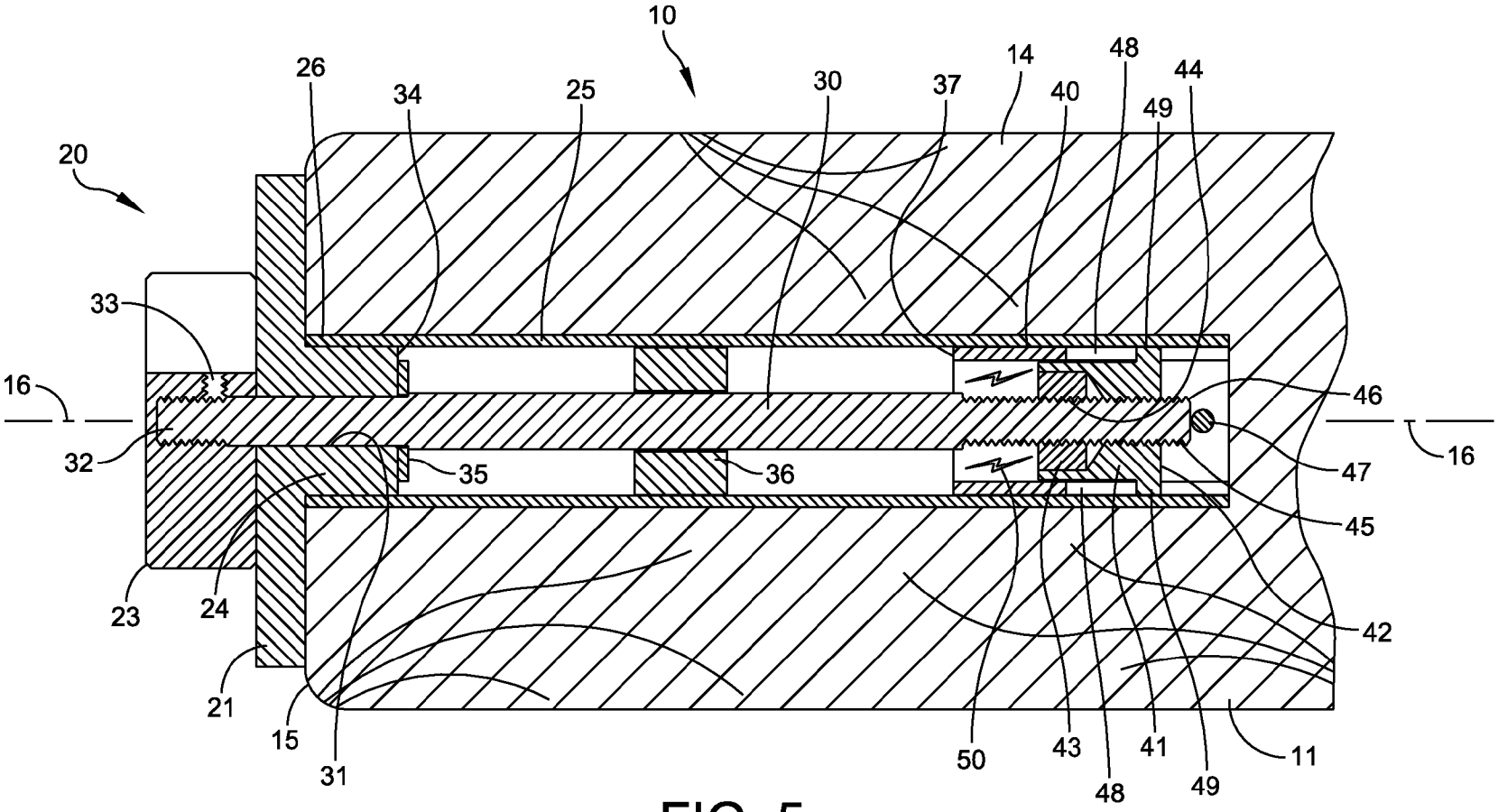
FIG. 5 is a cross-sectional view of the training device taken along lines 4-4 in FIG. 1 depicting an intermediate state that exists during a bat swing that produces inertial forces that overcome a magnetically generated restraining force.
Figure 6:
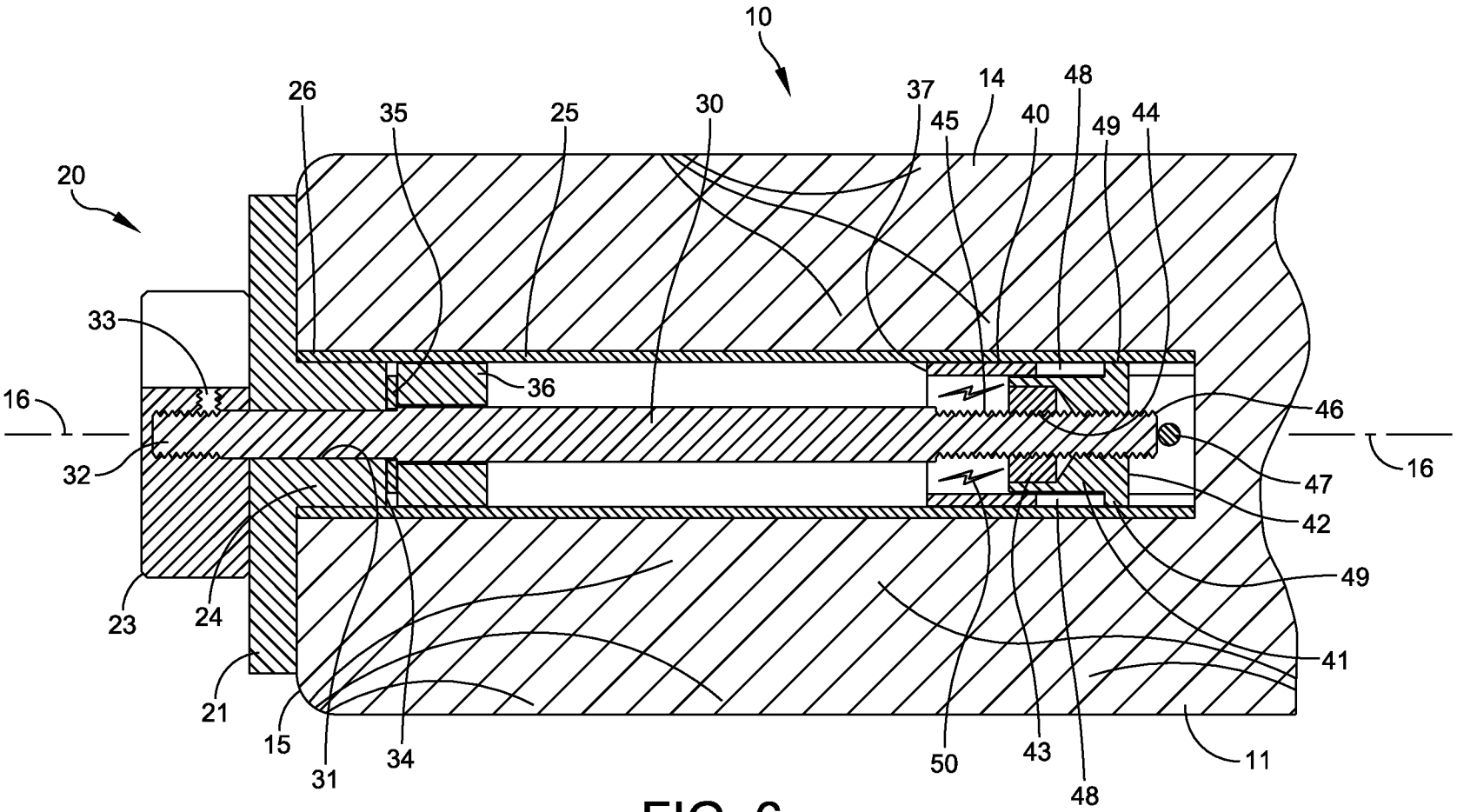
FIG. 6 is a cross-sectional view of the training device taken along lines 4-4 in FIG. 1 training device produces an audible snapping sound.

When a batter swings the bat 11, the ring slider 36 undergoes angular acceleration. Initially the magnetic force is sufficient to maintain the configuration in FIG. 4. This continues so along as the magnetic field acting on the ring slider 36 is sufficient to overcome inertial forces. However, with sufficient bat speed, the inertial forces acting on the ring slider 36 exceed the magnetic restraining force of the permanent magnet assembly 41. As shown in FIG. 5, the ring slider 36 then accelerates toward the end plate 21. When the ring slider 36 impacts the washer 35 as shown in FIG. 6, an audible snapping or clicking noise is produced. Determining the batter's hand position at the time of this audible snap or click provides an indication of whether the batter is swinging the bat properly.

After the bat swing, the batter may prepare for another practice swing. During this preparation the batter normally raises the distal end 15 of the bat above the handle 12 in FIG. 1. When this occurs, gravity initiates motion of the ring slider 36 towards the housing 40 and eventually a combination of the gravitation and magnetic forces return the ring slider 36 to the cocked position shown in FIG. 4.

Figure 7:
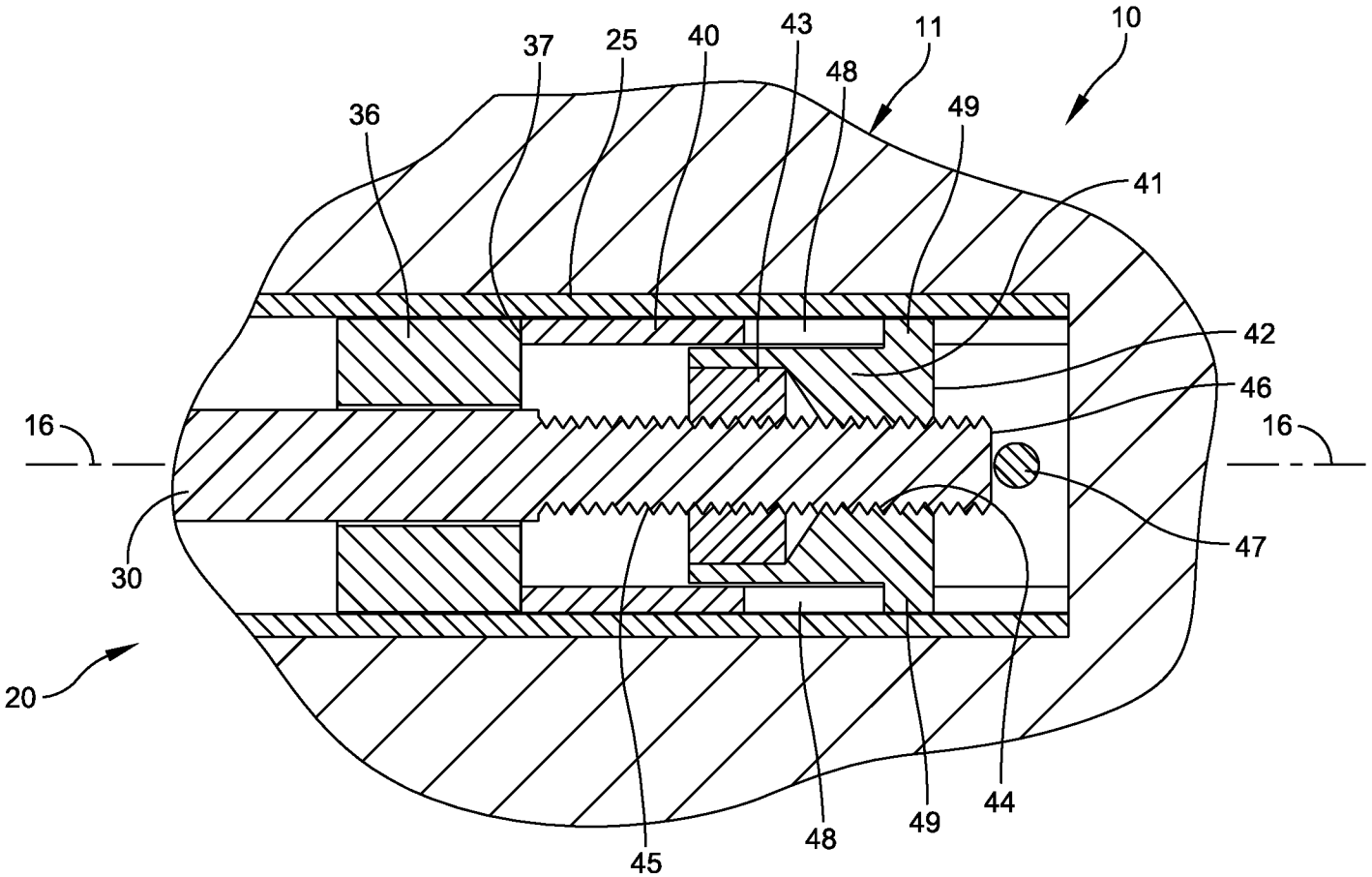
FIG. 7 depicts a portion of the bat swing training device that enables a batter to adjust the magnetic restraining force.

Now referring to FIG. 7, rotation of the shaft 30 in one direction by means of the force control knob 23 in FIG. 1 advances the permanent magnet subassembly 41 distally to an end position as shown in FIG. 7. In this position a minimum air gap exists between the permanent magnet 43 and the ring slider 36 so a maximum restraining force exists. The batter must make a good swing to cause the inertial forces acting on the ring slider 36 to exceed the magnetic attraction force exerted by the permanent magnet to accelerate toward the end plate 21 and strike the washer 35 as shown in FIG. 6. The opposite rotation of the shaft 30 causes the permanent magnet subassembly 41 to move proximally, or to the right in FIG. 7, until it reaches a proximal-most position at the pin 47. At this point, the magnetic force restraining the ring slider 36 at the stop 37 is at a minimal value. This adjustment enables the training aid to be adapted for use by persons of different capabilities. Moreover, as a batter swing improves, increasing the magnetic retraining force provides the batter a greater challenge.

From the forgoing description of the construction and operation of a bat training aid constructed in accordance with this invention, it will be apparent that this invention enables an individual to obtain a proper swing for maximum impact without any need for contacting a thrown ball. The weight of such a training aid can be adapted to match or closely match a batter's conventional bat weight. The training aid then provides a better simulation of the bat characteristics normally used by the batter. Bat weight adjustments can be made by adapting the depth of the cavity 18 shown as FIGS. 2 and 3. Thus this invention provides a bat training device that closely simulates the physical and additional characteristics of a conventional bat and allows the batter to perform multiple practice swings A batter does not have to interrupt his or her routine because there is no need for a batter to release his or her hands from the bat training device to reset or cock the training aid mechanism or take other like action to perform other operations that are required for prior bat training devices.

Thus it now will be apparent that the bat swing training device embodying this invention meets all the objectives of this invention. Specifically, this bat swing training device is adapted for swinging baseball and softball bats and is useful in enabling a batter to perfect his or her swing. There is no need for a ball to be thrown. Each bat swing training device has the look and feel of a conventional baseball bat.

Many variations and modifications can be made to this invention. For example, the steel washer 35 in FIGS. 2 and 4 through 7 could be eliminated. Although such a bat training device uses aluminum for all components except for the washer 35, the ring slider 36 and the permanent magnet 43, other materials such as carbon fiber can be used. Therefore, it is the intent of the appended application to cover all such variations and modifications as come within the true spirit and scope of this invention.

What is claimed is:

1. A bat swing training device for use in correcting a batter's swing comprising:

A) a bat with a proximal handle or grip, a handle portion and a distal end, said bat including an axial passage extending proximally from the distal tip barrel end into the bat to receive the training aid, B) a training aid including a structure received in the axial passage of said bat that, at a predetermined bat speed, generates a snapping sound, said training aid including:

i) a shaft extending longitudinally through and rotatable in said training aid, ii) first and second stops at longitudinally spaced positions along said shaft, iii) a magnet on said shaft proximate said first stop, and iv) a slider of a paramagnetic material mounted on said shaft intermediate said first and second stops that is magnetically attracted to said first stop whereby upon proper swinging the bat, inertial forces overcome the magnetic attraction and said slider accelerates to said second stop thereby to produce a sound, and C) means for affixing said training aid to the bat.

2. A bat swing training device as recited in claim 1 wherein said means for affixing includes an end plate that overlies the distal end of the bat including a bushing for rotatably supporting said shaft distally of said second stop, a shoulder facing distally to form said second stop and means for restraining axial motion of said shaft.

3. A bat swing training device as recited in claim 2 wherein said force control comprises a knob affixed to said shaft at the distal end thereof whereby rotation of said knob causes said shaft to rotate and said magnet to be displaced axially.

4. A bat swing training device as recited in claim 2 additionally including a washer on said shaft at said second stop for stopping said slider.

5. A bat swing training device as recited in claim 1 additionally comprising means for adjusting the distance between said magnet and said first stop.

6. A bat swing training device as recited in claim 5 wherein said means for adjusting includes a support for said magnet, said support being threaded on said shaft and means for preventing rotation of said magnet support about an axis of rotation for said shaft whereby rotation of said shaft alters an air gap between said magnet and said first stop.

7. A bat swing training device for use in correcting a batter's swing comprising:

A) a bat with a proximal handle or grip, a barrel portion, a distal end, said bat including an axial passage extending proximally from the distal tip barrel end into the bat, B) a training aid including a structure received in the axial passage of said bat that, at a predetermined bat speed, generates a snapping sound, said training aid including:

i) a shaft extending longitudinally through and being rotatable in said training aid, ii) first and second stops at longitudinally spaced positions along said shaft, iii) a magnet on said shaft proximate said first stop, iv) a slider of a paramagnetic material mounted on said shaft intermediate said first and second stops that is magnetically attracted to said first stop whereby upon proper swinging the bat, inertial forces overcome the magnetic attraction and said slider accelerates to said second stop thereby to produce a sound, and v) means for adjusting the distance between said magnet and said first stop, and C) means for affixing said training aid to the bat.

8. A bat swing training device as recited in claim 7 wherein said means for adjusting includes a support for said magnet, said support being threaded on said shaft and means for preventing rotation of said magnet support about an axis of rotation for said shaft whereby rotation of said shaft alters an air gap between said magnet and said first stop.

* * * * *